US006431177B1

(12) United States Patent
Sieggen et al.

(10) Patent No.: US 6,431,177 B1
(45) Date of Patent: Aug. 13, 2002

(54) CIGARETTE EXTINGUISHER AND STORAGE DEVICE

(76) Inventors: Marguerite A. Sieggen; Robert L. Sieggen, both of 1196 S. Rifle Cir., Aurora, CO (US) 80017-4224

( * ) Notice: Subject to any disclaimer, the term of this patent is extended or adjusted under 35 U.S.C. 154(b) by 0 days.

(21) Appl. No.: 09/524,678

(22) Filed: Mar. 13, 2000

(51) Int. Cl.[7] ..... A24F 13/18; A24D 1/10

(52) U.S. Cl. ..... 131/256; 131/190; 131/194; 131/187; 131/191; 131/235.1; 131/237; 131/240.1; D27/172; D27/105; D27/136

(58) Field of Search ..... 131/231, 235.1, 131/232.5, 240, 241, 242, 256, 174, 175, 240.1, 187, 191, 190, 194, 195, 199; D27/102, 136

(56) References Cited

U.S. PATENT DOCUMENTS

| | | | | | |
|---|---|---|---|---|---|
| 2,113,745 | A | * | 4/1938 | Pyatt | |
| 2,335,674 | A | * | 11/1943 | Horlick | |
| 2,715,961 | A | * | 8/1955 | Field | |
| 3,886,954 | A | * | 6/1975 | Hannema et al. | 131/175 |
| 4,585,014 | A | * | 4/1986 | Fry | 131/175 |
| 4,587,980 | A | | 5/1986 | Tipper | |
| 4,660,575 | A | | 4/1987 | Andreason et al. | |
| 4,809,715 | A | * | 3/1989 | Musetti | 131/256 |
| D303,438 | S | | 9/1989 | Higgins | |
| 4,886,076 | A | * | 12/1989 | Gilbert et al. | 131/256 |
| 4,984,586 | A | | 1/1991 | Nae-Won | |
| 5,002,073 | A | | 3/1991 | Chiang | |
| 5,345,953 | A | | 9/1994 | Taylor | |
| 5,377,826 | A | | 1/1995 | Ayres et al. | |
| 5,385,157 | A | * | 1/1995 | Smith et al. | 131/256 |
| 5,862,809 | A | | 1/1999 | Nicotra | |
| D409,327 | S | * | 5/1999 | Brock | D27/136 |
| 6,273,094 | B1 | * | 8/2001 | Potter | 131/256 |

FOREIGN PATENT DOCUMENTS

| | | | |
|---|---|---|---|
| FR | 363804 | * | 8/1906 |
| GB | 545899 | * | 6/1942 |
| GB | 2174286 | * | 11/1986 |

* cited by examiner

*Primary Examiner*—Jose Fortuna
*Assistant Examiner*—Carlos Lopez
(74) *Attorney, Agent, or Firm*—Dale J. Ream

(57) ABSTRACT

A cigarette extinguishing and storage device, comprises a first hollow cylinder having an open end and a closed end. A second hollow cylinder constructed of a heat resistant material is concentric to the first cylinder and mounted therein. The second cylinder includes an open end adjacent the open end of the first cylinder and a closed end longitudinally spaced from the closed end of the first cylinder, thus forming an interior space therebetween. A plurality of partitions extend between the closed ends of the first and second cylinders and are positioned to form a plurality of dead air spaces for inhibiting a heat exchange between the closed ends. The second cylinder presents a diameter sufficient to permit a lit cigarette to be received therein. The device includes a third hollow cylinder having an open end and a closed end and having a diameter greater than a diameter of the first cylinder for releasably receiving the first cylinder therein.

10 Claims, 5 Drawing Sheets

CIGARETTE EXTINGUISHER AND STORAGE DEVICE

BACKGROUND OF THE INVENTION

The present invention relates generally to a cigarette extinguisher and, more particularly, to a device for extinguishing a partially smoked cigarette and for storing said extinguished cigarette for later use.

Finding a suitable location and sufficient time for smoking an entire cigarette has become increasingly difficult both in the workplace and in other public facilities. As a result of a more health conscious public and increased government regulations, smokers often have difficulty finding ashtrays for proper disposal of used cigarettes or having a place to store a cigarette for later use.

Several devices have been proposed in the prior art for snuffing a cigarette and storing it for later use, such as those in U.S. Pat. Nos. 5,345,953, 4,660,575, 5,377,826, 4,587,980, and 5,002,073. Although assumably effective for their intended purposes, the existing devices do not provide an attractive, lightweight, and inexpensive device that can be easily carried in one's pocket while still minimizing a heat exchange between a lit cigarette and an end of the device.

Therefore, it is desirable to have a cigarette extinguisher and storage device which includes a heat resistant insert within lightweight, non-heat resistant hollow cylinders. Further, it is desirable to have a device which includes a plurality of partitioned air spaces between the insert and an end of the device for further inhibiting a heat exchange.

SUMMARY OF THE INVENTION

An apparatus according to a preferred embodiment of the present invention for extinguishing and storing a cigarette includes a first hollow cylinder having an open end and a closed end. A second hollow cylinder constructed of a heat resistant material is mounted within the first cylinder. The second cylinder includes an open end adjacent the open end of the first cylinder and a closed end longitudinally spaced apart from the closed end of the first cylinder. The second cylinder is adapted to receive and retain a cigarette therein, lit end first, in a sliding fit relationship.

As the closed end of the second cylinder does not extend all the way to the closed end of the first cylinder, an interior space is formed therebetween. Within that interior space, a plurality of partitions or dividers extend between the respective closed ends. The partitions separate the interior space into a plurality of dead air spaces. Heat which may be transferred through the closed end of the second cylinder is inhibited from being transferred to the closed end of the first cylinder by the plurality of partitions and distinct dead air spaces. This construction enables the exterior of the device to be constructed of lightweight, inexpensive, non-heat resistant materials without concern that heat from a lit cigarette placed within the second cylinder will be felt by a user.

The device includes a third hollow cylinder having an open end and a closed end. The third cylinder presents a diameter slightly larger than a diameter of the first cylinder such that the first cylinder may be slidably received therein. A flange extending radially about the first cylinder and longitudinally displaced from the open end thereof acts as a stop so as to regulate the extent to which the first cylinder is received within the third cylinder. The third cylinder acts as a cap and, when coupled to the first cylinder, prevents ambient air from entering therein to fuel the continued combustion of the cigarette. A clip attached to the closed end of the third cylinder allows the device to be releasably attached to a user's shirt pocket, to a pack of cigarettes, or other selected item.

Therefore, a general object of this invention is to provide a device for extinguishing and storing a conventional cigarette.

Another object of this invention is to provide a device, as aforesaid, having a heat resistant insert which can retain a lit cigarette.

Still another object of this invention is to provide a device, as aforesaid, having a plurality of partitions which form dead air spaces for inhibiting a heat exchange between the insert and an end of the device.

Yet another object of this invention is to provide a device, as aforesaid, which is lightweight, aesthetically attractive, and inexpensive to manufacture.

A further object of this invention is to provide a device, as aforesaid, having a first cylinder with a heat resistant insert adapted to receive a lit cigarette and which is receivable in a second cylinder such that the cigarette is quickly extinguished due to a lack of combustible gases.

A still further object of this invention is to provide a device, as aforesaid, which can be attached to a user's shirt pocket, cigarette case, or pack of cigarettes.

Other objects and advantages of this invention will become apparent from the following description taken in connection with the accompanying drawings, wherein is set forth by way of illustration and example, an embodiment of this invention.

DETAILED DESCRIPTION OF THE PREFERRED EMBODIMENT

Figure 1:
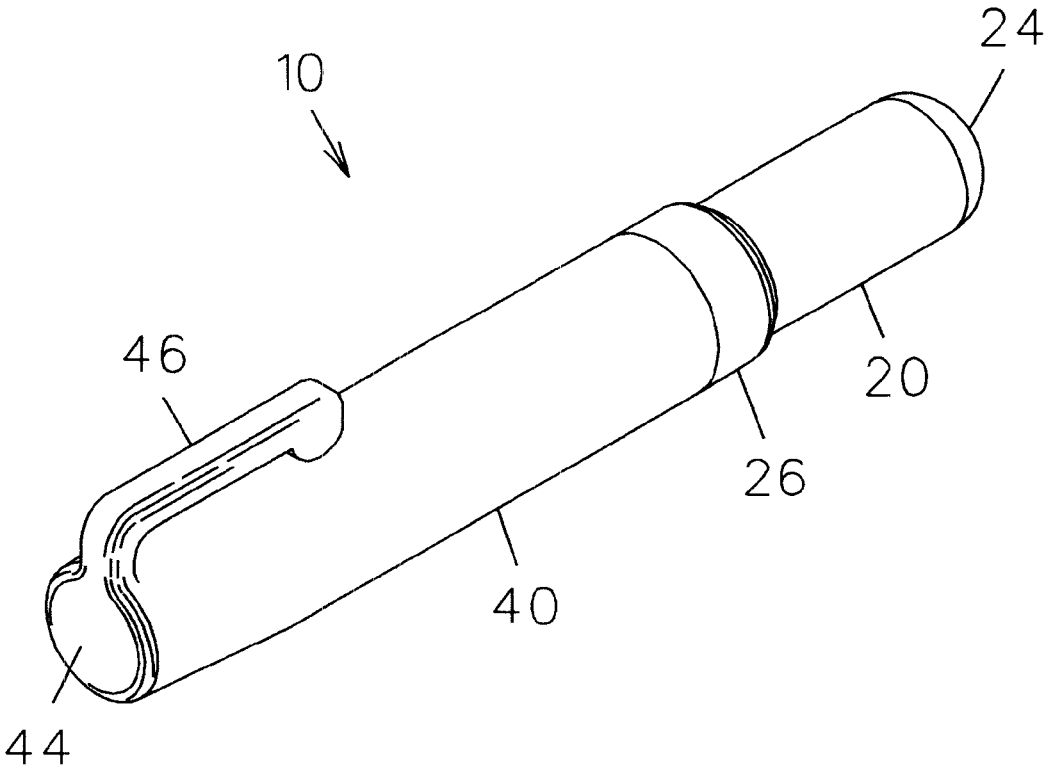
FIG. 1 is a perspective view of the cigarette extinguisher and storage device according to the preferred embodiment of the invention.

The preferred embodiment of the cigarette extinguishing and storage device 10 will now be described with reference to FIGS. 1–5 of the accompanying drawings.

The device 10 comprises a first hollow cylindrical member 20 having a closed end 24 and an open end 22. The first member 20 is preferably constructed of a lightweight, inexpensive material such as plastic although other materials such as metal would also be suitable. The first member 20 further includes a flange 26 spaced from the open end 22 and extending radially about the exterior surface thereof.

Figure 2:
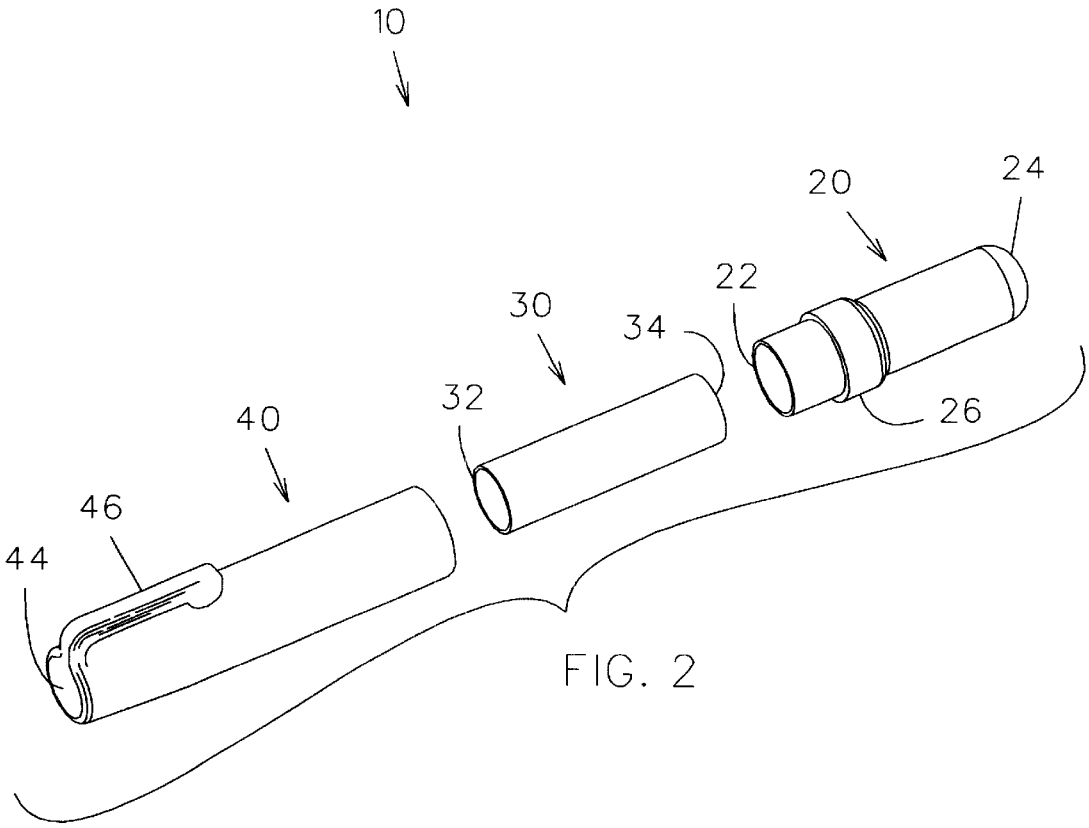
FIG. 2 is an exploded view of the device as in FIG. 1.
Figure 3:
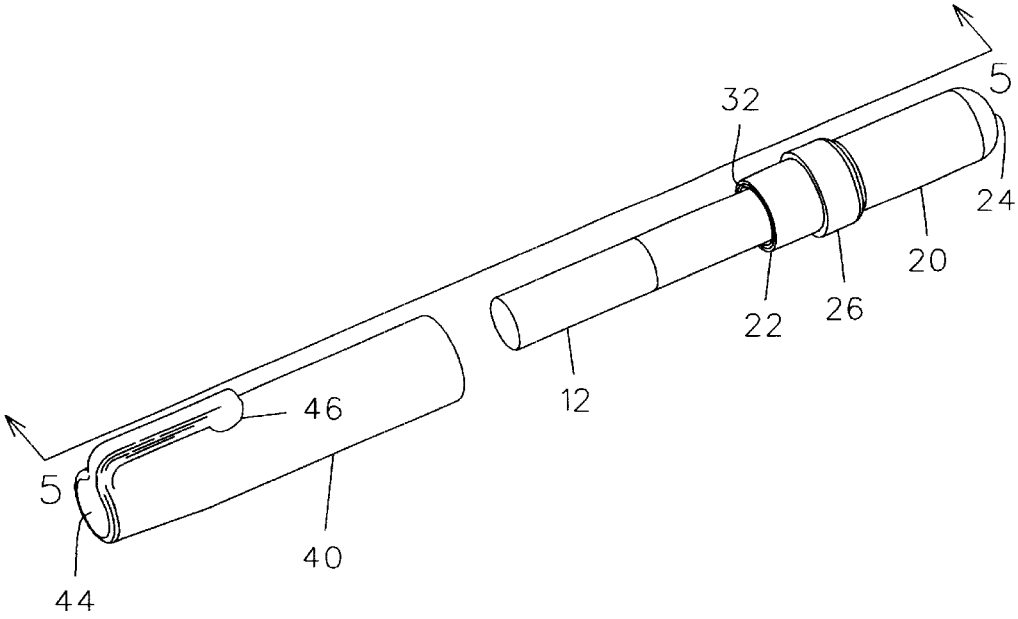
FIG. 3 is a perspective view of the device as in FIG. 1 with the cap removed and with a cigarette retained within the first cylinder insert.
Figure 4C:
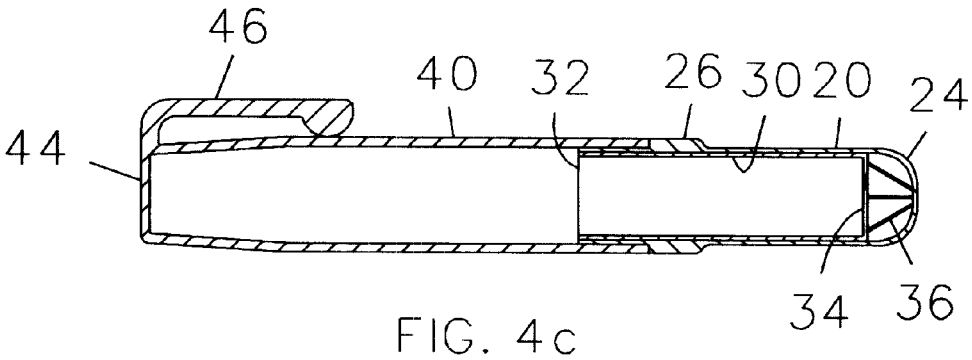
FIG. 4*c* is a sectional view taken along line 4*c*—4*c* of FIG. 4*b.
Figure 4A:
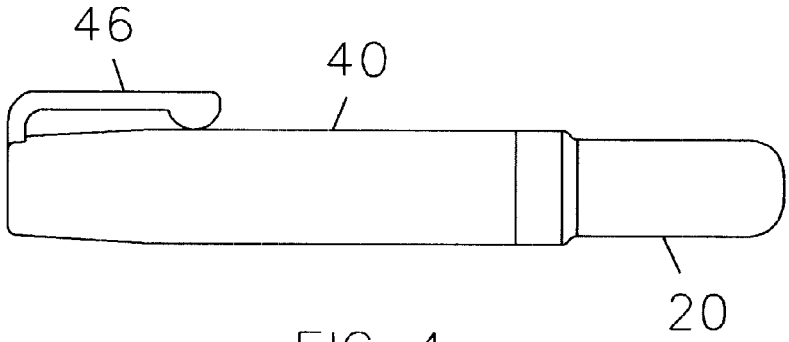
FIG. 4*a* is a side view on a reduced scale of the device as in FIG. 1.
Figure 4B:
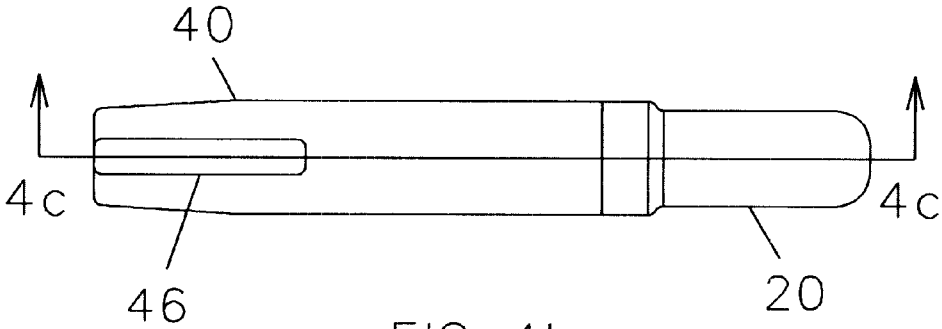
FIG. 4*b* is a top view of the device as in FIG. 4*a;*
Figure 5:
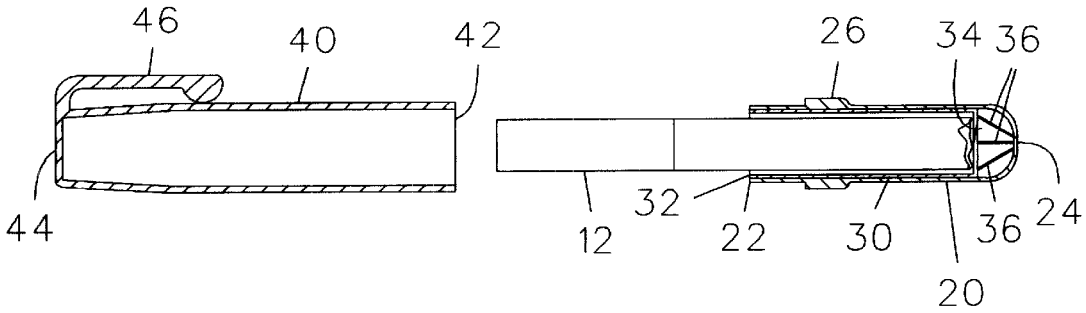
* and FIG. 5 is a sectional view taken along line 5—5 of FIG. 3.

The device 10 further includes a second hollow cylindrical member 30 having an open end 32 and a closed end 34 (FIG. 2). The second member 30 has a length that is shorter and diameter that is slightly smaller than the length and diameter of the first member 20. The second member 30 is fixedly mounted within the first member 20 and functions as an insert therein. The open ends of the first 20 and second 30 members are concentrically aligned (FIG. 3). Therefore, as the second member 30 is shorter than the first member 20, an interior space is formed within the first member 20 between the closed ends 24, 34 of the first 20 and second 30 members, respectively (FIGS. 4*c* and 5). The second member 30 is constructed as a press fitted metal plate although other heat resistant materials are suitable as well, such as thermoplastic or ceramic material, or other material coated with metals or enamels.

A plurality of partitions 36 extend within the interior space between the closed ends 24, 34 of the first 20 and second 30 members. At least one partition extends longitudinally therebetween while other partitions are angled so as to divide the interior space into a plurality of separate chambers or dead air spaces (FIG. 5). This structure of partitions 36 and air spaces inhibits a heat exchange between the closed ends 24, 34. More particularly, heat from a lit cigarette 12 inserted into the second member 30 is diminished and the rate of transfer is slowed as it is distributed into the plurality of air spaces and through multiple partitions. Thus, the heat from a lit cigarette is not efficiently transferred to the non-heat resistant surface of the first member 20 and is not felt by the user. This structure is necessary in that the closed end 34 of the second member 30 can become very hot, especially where a user takes a deep draw on the cigarette immediately prior to inserting it into the second member 30.

The cigarette extinguishing and storage device 10 further includes a third hollow cylindrical member 40 having a closed end 44 and an open end 42. The diameter of the third member 40 is slightly larger than the diameter of the first member 20 such that the first member 20 is selectably received therein in a friction fit relationship. The third member 40, therefore, acts as a cap. The diameter of the flange 26 extending about the first member 20 is at least as large as that of the third member 40 such that the flange 26 acts as a stop to regulate how far the first member 20 may be inserted into the third member 40. The flange 26 also acts as a seal, preventing air from entering the enclosure formed by the first 20 and third 40 members when slidably coupled. Therefore, when the first 20 and third 40 members are coupled, a lit cigarette 12 therein is quickly extinguished by the lack of combustible gases. The quick extinguishing of a cigarette prevents the buildup of tars which would create a bitter taste when the cigarette is again ignited for smoking. A clip 46 extends from an exterior surface of the closed end 44 of the third member 40 for attaching the device 10 to a person's shirt pocket, cigarette case, pack of cigarettes, or the like.

While the preferred embodiment of the device 10 is configured to retain standard diameter machine made cigarettes, it is understood that the cylindrical members can easily be made longer and with larger diameters so as to accommodate other types of cigarettes or even cigars.

In use, a cigarette 12 is slidably inserted, lit end first, into the second member 30 or insert. The first member 20, with the unlit end of the cigarette 12 extending therefrom, is inserted into the third member 40 until the flange 26 precludes further insertion. As the enclosure is sealed by this insertion, the cigarette 12 is quickly extinguished for lack of access to combustible gases. The third member 40 may be removed from the first member 20 and the cigarette 12 slidably removed from the second member 30 when a user desires to once again light and finish smoking the cigarette.

Accordingly, it can be seen that the present invention provides a cigarette extinguishing and storage device that is lightweight and attractive while ensuring that heat from an ignited cigarette placed therein is not felt by a user.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A cigarette extinguishing and storage device, comprising:

a first hollow cylinder having an open end and a closed end;

a second hollow cylinder concentric to said first cylinder and mounted therein, said second cylinder having an open end aligned with said open end of said first cylinder and a closed end longitudinally spaced from said closed end of said first cylinder;

a plurality of partitions extending between said closed end of said first cylinder and said closed end of said second cylinder, said positioned to form a plurality of separate air chambers therebetween; and a third hollow cylinder having a closed end and an open end and having a diameter greater than a diameter of said first cylinder, said third cylinder adapted to releasably receive said first cylinder open end first in a sliding fit relationship.

2. A device as in claim 1 further comprising a flange extending radially about said first cylinder intermediate said open and closed ends thereof and having a diameter equal to a diameter of said third cylinder, said flange adapted to regulate the longitudinal extent to which said first cylinder is received within said third cylinder.

3. A device as in claim 1 wherein said second cylinder defines an inner diameter sufficient to permit a lit cigarette to be slidably received therein.

4. A device as in claim 1 further comprising a clip attached to the exterior of said closed end of said third cylinder adapted to removably attach said third cylinder to a selected support.

5. A device as in claim 1 wherein said first and third cylinders are constructed of a plastic material.

6. A device as in claim 1 wherein said second cylinder is constructed of thermoplastic.

7. A device as in claim 1 wherein said second cylinder is constructed of a ceramic material.

8. A device as in claim 1 wherein said first and third cylinders are adapted to retain a cigarette having a conventional length when said first cylinder is received in said third cylinder.

9. A cigarette extinguishing and storage device, comprising:

a first tubular member having an open end and a closed end;

a second tubular member fixedly mounted to the inner surface of said first member, said second member having an open end aligned with said open end of said first member and a closed end longitudinally spaced from said closed end of said first member, said closed ends of said first and second members and the inner surface of said second member defining an interior space;

a plurality of partitions positioned in said interior space for inhibiting a heat exchange between said closed end of said second member and said closed end of said first member, said partitions positioned angularly relative to one another to form a plurality of dead air spaces; and a third tubular member having opposed open and closed ends and a diameter greater than a diameter of said first member for selectably receiving said first tubular member open end first in a sliding fit relationship.

10. A device as in claim 9 wherein said second tubular member presents a diameter sufficient to permit a lit cigarette to be slidably received therein.

* * * * *